US006073512A

United States Patent [19]

McCormick et al.

[11] Patent Number: 6,073,512

[45] Date of Patent: Jun. 13, 2000

[54] MANUAL QUICK CHANGE TOOL CHANGER

[75] Inventors: Peter McCormick, Dallas; Dan Beall, Allen, both of Tex.

[73] Assignee: Delaware Capital Formation, Inc., Wilmington, Del.

[21] Appl. No.: 09/210,970

[22] Filed: Dec. 14, 1998

[51] Int. Cl.[7] ..... G05G 5/06; G05G 1/00

[52] U.S. Cl. ..... 74/528; 74/543; 74/545; 74/527

[58] Field of Search ..... 74/527, 528, 529, 74/536, 543–548, 500.5, 501.5 R, 502.2, 489, 813 R, 813 L, 531

[56] References Cited

U.S. PATENT DOCUMENTS

| | | | |
|---|---|---|---|
| 3,375,993 | 4/1968 | Hayes | 242/84.1 |
| 4,007,645 | 2/1977 | Dove et al. | 74/501.5 R |
| 4,032,163 | 6/1977 | Holt . | |
| 4,406,195 | 9/1983 | Kruger et al. . | |
| 4,499,800 | 2/1985 | Stahl . | |
| 4,520,550 | 6/1985 | Dunn et al. . | |
| 4,604,787 | 8/1986 | Silvers et al. . | |
| 4,660,274 | 4/1987 | Goumas et al. . | |
| 4,850,765 | 7/1989 | Ramunas . | |
| 5,018,266 | 5/1991 | Hutchinson et al. . | |
| 5,044,063 | 9/1991 | Voellmer . | |
| 5,052,242 | 10/1991 | Look et al. | 74/489 X |
| 5,065,492 | 11/1991 | Von Haas et al. . | |
| 5,131,706 | 7/1992 | Appleberry . | |
| 5,267,484 | 12/1993 | Cukelj | 74/543 |
| 5,704,257 | 1/1998 | Kottke et al. | 74/813 L |
| 5,887,489 | 3/1999 | Zerrer | 74/527 |
| 5,897,072 | 4/1999 | Lok | 74/546 X |

OTHER PUBLICATIONS

System BAKRA, EOC Normalien, 1992.

*Primary Examiner*—Vinh T. Luong
*Attorney, Agent, or Firm*—Dinnin & Dunn, P.C.

[57] ABSTRACT

A manual quick change tool changer, said tool changer including a master plate. The master plate connected to a rotatable sprocket with the sprocket having a plurality of teeth. A thrust bearing engaging the sprocket. A handle connected to the sprocket such that the handle moves a predetermined distance. The tool changer further including a secondary plate that mates with the master plate. The secondary plate further including a plurality of leaves such that the plurality of teeth from the master plate locks underneath the leaves of the secondary plate to secure the master plate to the secondary plate.

20 Claims, 3 Drawing Sheets

MANUAL QUICK CHANGE TOOL CHANGER

BACKGROUND OF THE INVENTION

1. Field of the Invention

The present invention relates to tool changers and more particularly to a manual tool changer for the robotic industry.

2. Description of the Related Art

Tool changers have been known in the robotic industry for numerous years. The prior art has many automatic and manual tool changers that allow a robot to change a tool automatically or with assistance from a user. Many of these tool changers must operate continuously during a year, this can have a robot changing guns and/or tools once per minute or one million times per year. However, in other applications the robot tool or gun may be kept in the same robot for weeks until the robot senses a failure and then automatically switches to a standby gun so minimum downtime occurs on the moving manufacturing line.

Numerous robot tool changing operations are designed and performed automatically without manual intervention. With many of these utilizations it is highly desirable for the tool changing apparatus to be a passive type, that is free from relatively expensive and maintenance requiring switches, motors and similar components. Furthermore, in the prior art it is desirable for the robot to be able to simultaneously interchange a plurality of tools during each tool changing operation if necessary. Many of these automatic robotic tool changers are very expensive to maintain and build because of the numerous parts needed to perform the automatic tool changing operation.

Therefore, there is a need in the art for a simplified manual robotic tool changer. Furthermore, there is a need in the art for a reduced cost tool changer that is capable of manual operation while still being capable of changing tools once or twice a minute depending on the line.

SUMMARY OF THE INVENTION

One object of the present invention is to provide a manual quick change tool changer.

Another object of the present invention is to provide a manual quick change tool changer for the robotic industry.

Yet a further object of the present invention is to reduce the cost and downtime of tool changers.

Yet a further object of the present invention is to provide a tool changer that is capable of higher pay load capacities.

Still a further object of the present invention is to provide a low friction rotating sprocket in order to lock a tool changer.

To achieve the foregoing objects a manual quick change tool changer includes a master plate, wherein the master plate is connected to a rotable sprocket with the sprocket having a plurality of teeth. The tool changer also includes a thrust bearing which engages the sprocket. A handle is also connected to a sprocket where that handle moves a predetermined distance. Finally, the tool changer includes a secondary plate that mates with the master plate. The secondary plate has a plurality of leaves wherein those leaves lock with the plurality of teeth to secure the master plate to the secondary plate in a working relationship.

One advantage of the present invention is that the tool changer is more economical to build and maintain.

A further advantage of the present invention is that the tool changer minimizes friction by using a thrust bearing around the sprocket member.

A further advantage of the present invention is that the tool changer is capable of higher payload capacities by spreading of the center point of the tool changer.

A further advantage of the present invention is that it pulls the tool from the change table during a change over.

Other objects, features and advantages of the present invention will become apparent from the subsequent description and appended claims, taken in conjunction with the accompanying drawings.

Figure 1:
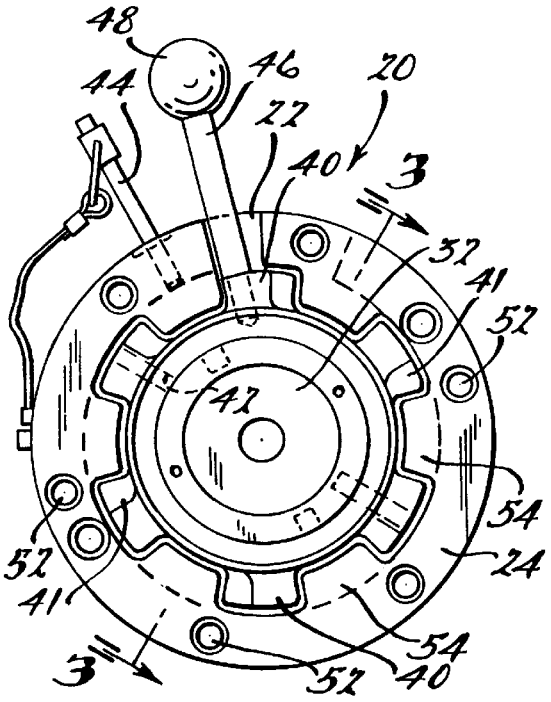
FIG. 1 shows a plan view of the present invention in the unlocked position.

BEST MODE FOR CARRYING OUT THE INVENTION AND DESCRIPTION OF THE PREFERRED EMBODIMENT(S)

Referring to the drawings, a manual quick change tool changer 20 according to the present invention is shown. Generally, the quick change tool changer 20 operates manually. A laborer or user will have to lock and unlock the tool changer 20 to secure a tool to the appropriate tool holder, i.e., a robot arm or other device. The tool changer 20 is designed to withstand the environment of an automatic manufacturing line such as found in an automobile factory or other high tech manufacturing facility. The tool changer 20 may be changed as much as one or two times per minute which could turn out to be approximately one million tool changes per year for a specific robot arm. However, in many applications tool changers are used on a specific robot arm and the tool is only changed if the gun fails which can occur as often as every few weeks. In this type of environment a robot will sense the failure of the tool and then will automatically swap or switch to a standby gun so that there is little or no downtime on the line in the manufacturing plant. The quicker the ability for the robot arm to change its tool through the tool changer, the more efficient and cost effective the manufacturing line is.

Figure 2:
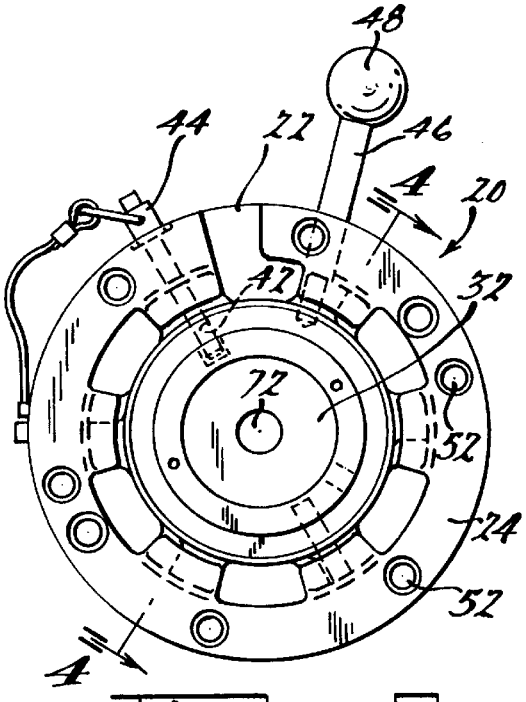
FIG. 2 shows the present invention in the locked position.
Figure 3:
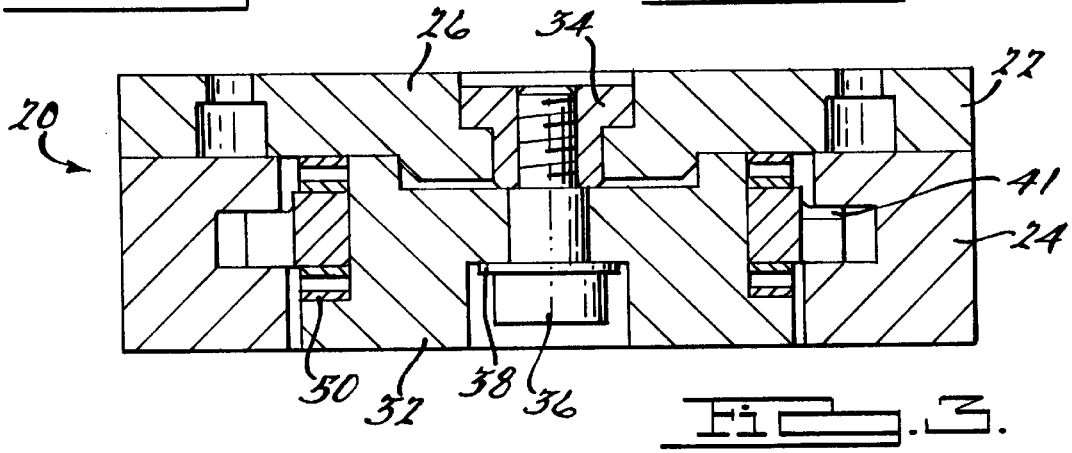
FIG. 3 shows a cross section of the present invention in the unlocked position taken along line 3—3 of FIG. 1.
Figure 4:
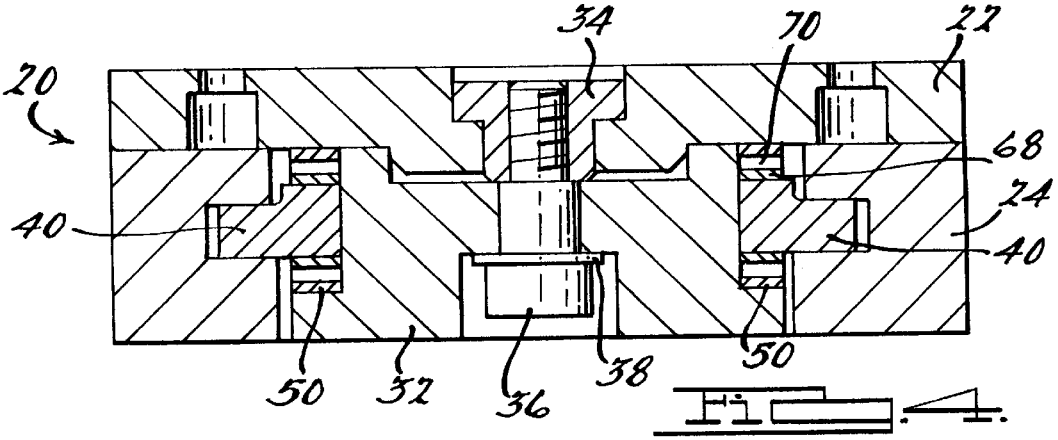
FIG. 4 shows a cross section of the present invention in the locked position taken along line 4—4 of FIG. 2.
Figure 5:
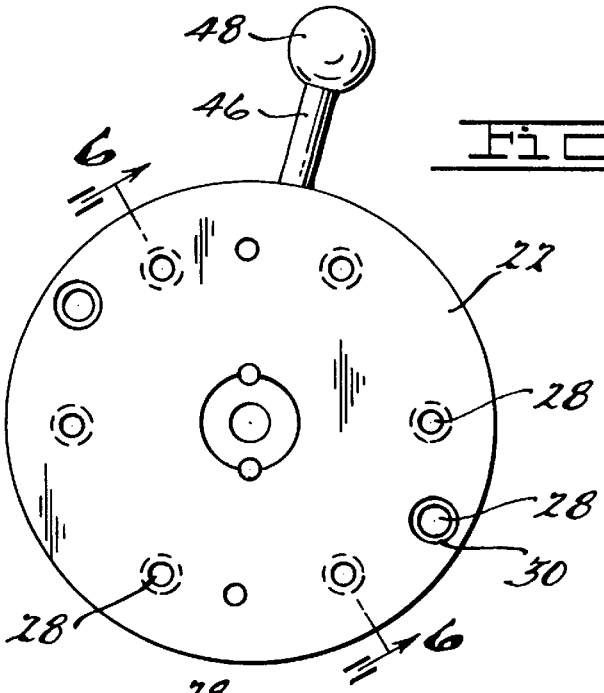
FIG. 5 shows a bottom view of the master plate.
Figure 6:
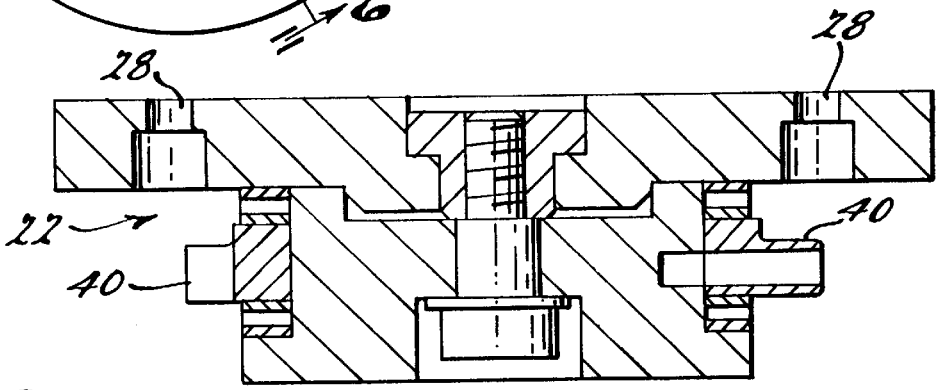
FIG. 6 shows a cross section of the master plate taken along line 6—6 of FIG. 5.
Figure 7:
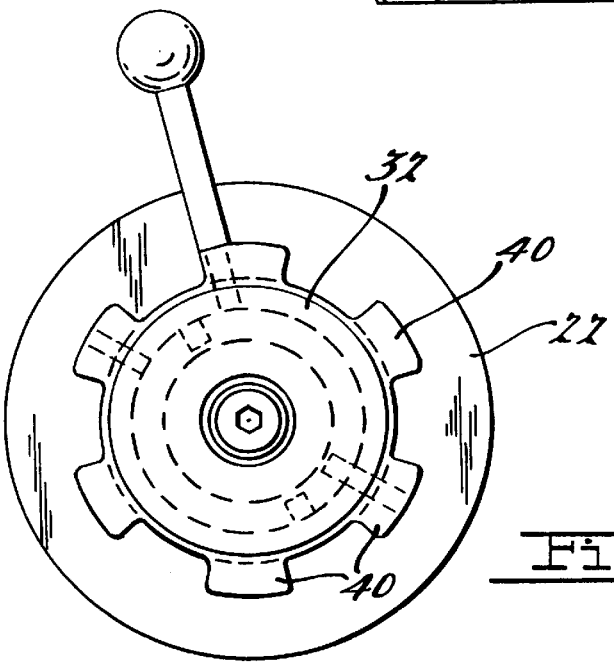
FIG. 7 shows a top view of the master plate.
Figure 8:
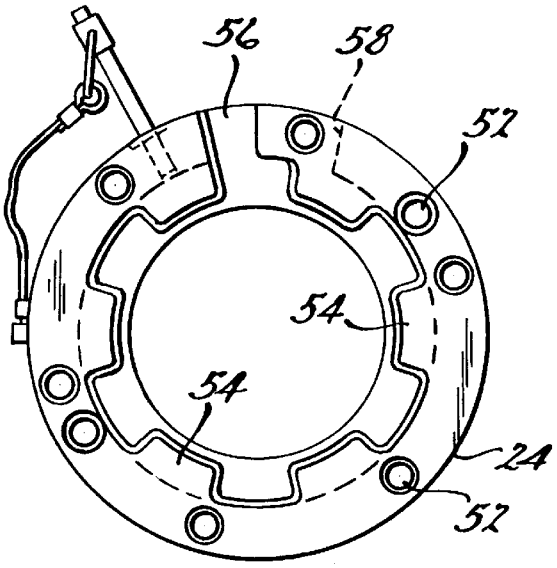
FIG. 8 shows the top view of the secondary plate.
Figure 9:
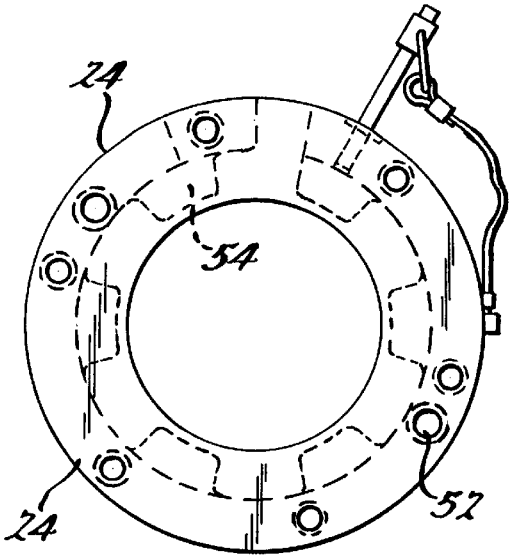
FIG. 9 shows a bottom view of the secondary plate.
Figure 10:
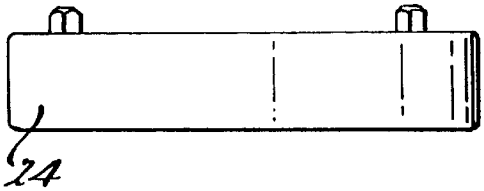
FIG. 10 shows a side view of the secondary plate.
Figure 11:
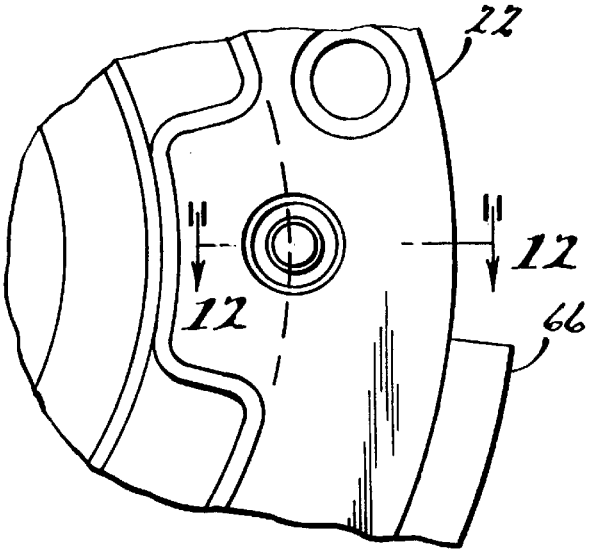
FIG. 11 shows an alternate embodiment of the present invention having a utility module.
Figure 12:
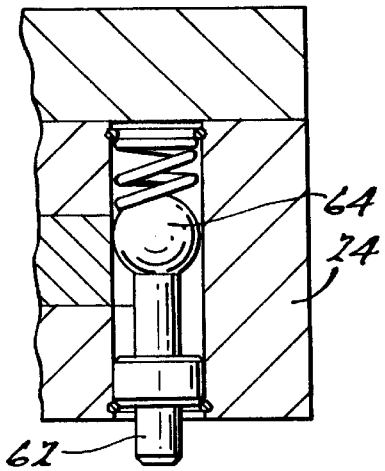
FIG. 12 shows an alternate embodiment of the present invention with a safety lock.

FIGS. 1 through 4 show the manual quick change tool changer 20 in both the unlocked and locked position. The tool changer 20 includes two principle members. The first is the master plate 22 which attaches to the robot arm and/or the working platform. The second part is the secondary plate or tool plate 24 which attaches to the tool and inter engages with the master plate 24 to create a secure attachment of tool to robot arm.

The master plate 22 generally has a circular shape and includes the base member 26. The base member 26 includes a plurality of orifices 28 of which at least one of the orifices includes a bushing member 30 on the inside surface of the orifice 28. Fastened to the base member 26 is a sprocket member 32. The sprocket member 32 is connected via a fastening means. In the preferred embodiment the sprocket 32 is fastened to the base member 26 by a nut 34, torque shoulder bolt 36 and washer 38 configuration. It should be noted that any other type of fastening means available may be used in place of the shoulder bolt and nut such as screws, rivets, etc. The sprocket member 32 includes a plurality of teeth 40 which create a lock sprocket mechanism for use in mating with and interacting with the secondary plate 24. One of the teeth includes an orifice 42 for receiving a ball plunger locking mechanism 44. However, it should be noted that any other type of locking mechanism may be used to lock the tool changer in place. The sprocket 32 also includes a bar lever 46 with a ball knob 48 for use in turning the sprocket member 32 from the locked to unlocked position within the tool changer unit. It must be noted that the lever 46 may be equipped with various types of handles depending on the user requirements and/or environment of the tool changer. The master plate 22 also includes a thrust bearing 50 that includes a washer 68 and needle 70. The thrust bearing 50 surrounds the teeth 40 of the sprocket 32. This will allow the lever handle 46 to rotate the sprocket teeth 40 with reduced friction. The bearing 50 surrounds both sides of the plurality of teeth 40 of the sprocket unit. It should be noted that in the preferred embodiment the master plate 22 and sprocket 32 are made of metal material but that any other hardened material may be used such as ceramics, very hard plastics or rubbers, or other metal alloys depending on the needs of the users environment.

The other main component of the tool changer 20 is the secondary plate 24 which is generally connected to the tool that is used in working on the product such as automobiles, microprocessor boards, etc. The secondary plate 24 is generally circular in shape. The secondary plate 24 includes a plurality of orifices 52 used to connect the secondary plate 24 to the tool. The secondary plate 24 also includes a plurality of leaves 54 which have rounded edges on both the outer leaf portion and the inner leaf portion. The leaves 54 create a locking mechanism which interacts with the plurality of teeth 40 on the master plate 22 to securely fasten the secondary plate 24 to the master plate 22 during robotic operations. The secondary plate 24 also includes an opening 56 on its top surface for inserting the handle 46 of the master plate 22. Adjacent to the opening in the secondary plate 24 there is a channel 58 which allows for rotation of the lever member 46 in the secondary plate unit. The lever member 46 moves a predetermined distance, in the preferred embodiment this distance is 30° from a locked to unlocked position. The lever member 46 slides along in the channel 58 so the secondary plate 24 will lock with the master plate 22. The secondary plate 24 also includes a ball lock pin member 44 which mates with the ball lock orifice 42 in the master plate 22 to lock the secondary plate 24 to the master plate 22 when in the locked position. The ball lock pin member 44 releases by pressing a button on the end of the pin member which will release a ball and release the ball lock pin member 44 from the orifice 42 in the master plate 22. With the master plate 22 locked to the secondary plate 24 the tool will be locked to the robotic arm or other machine and be capable of performing its work on the line or other products. The ball lock pin member 44 also is connected to the secondary plate 24 such that when the pin is out of the orifice 42 the pin system will be connected via a wire 60 or other connecting mechanism to secondary plate 24. In the preferred embodiment the secondary plate 24 is made of a metal material but it should be noted that any other hard plastic or ceramic or other alloy type metal material may be used.

In operation the tool changer 20 works by having the master plate 22 connected to, for example a robot arm, and the secondary plate 24 connected to a tool or a plurality of tools. The master plate 22 on the robot arm is placed, such that the handle 46 goes through the handle opening 56 on the secondary plate 24, and interengages with the secondary plate 24. A user or operator of the robotic arm will come along and slide the lever 46 on the master plate 22 through the channel on the secondary plate 24 such that the lever locks the secondary plate 24 to the master plate 22. Locking is accomplished by having the plurality of teeth 40 rotate underneath the plurality of leaves 54 on the secondary plate 24 so that the leaves 54 and teeth 40 will contact each other creating a secured locking mechanism such that the robotic arm is physically secured to the tool and the tool can do the work on the moving automatic line. When the operator rotates the lever 46 and hence the tool changer into the locked or closed position the pin ball lock mechanism 44 will slide into the orifice 42 in the master plate 22 thus securing the master plate 22 to the secondary plate 24 and allowing no further rotation of the sprocket 32 with relation to the secondary plate 24. It should also be noted that the sprocket 32 of the master plate will spread the effective center point of the tool changer to the outer diameter such that it will enable higher pay load capacities on the tool changer mechanism. Furthermore, it should be noted that the plurality of teeth 40 on the master plate 22 have a slope 41 such that when the sprocket 32 is rotated the slope on the teeth 40 will "pull up" the tool from the table the tool is sitting on during the change over period. This creates less stress on the tool and the user manually operating the lever mechanism. It should further be noted that the tool changer 20 creates a central pivot point 72 which makes rotation of the lever arm and sprocket member easier.

In an alternate embodiment a locking pin 62 is position on the bottom sid e of the secondary plate 24. The locking pin 62 will have a ball and spring member 64 that will allow a customer to make a linkage to their tooling table such that when a tool is on the table the tool changer 20 can be unlocked but when the tool is away from the table the cam is locked such that the secondary member 24 will remain locked to the master plate 22 creating a tool for use on the manufacturing line. Thus, the lock mechanism will prevent the unlocking of the tool from the robotic arm except when it is set down at the tool storage station.

In another alternate embodiment the master plate 22 has connected to a side thereof an electrical and air utility module 66. The electrical and air utility module 66 will allow for the electrical activation of a light or other warning buzzer system ensuring that the unit has been placed in the locked position or is in the unlocked position. The electrical and air utility module 66 will also be able to pass air and electrical power through the tool changer to the end of the robot tool such that air and electricity may be used at the point of interaction with the device being worked on by the robotic arm.

The above embodiments have been shown for use on the robotic arm but it should be noted that the tool changer 20 can be used for any tool that is necessary such as in a drill press or other machine capable of holding a tool and using a tool on a manufacturing line or other type of industrial use.

The present invention has been described in an illustrative manner, it is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A manual quick change tool changer, said tool changer including:

a master plate, said master plate connected to a rotatable sprocket, said sprocket having a plurality of teeth;

a thrust bearing engaging said sprocket;

a handle connected to said sprocket, said handle moves a predetermined distance;

a secondary plate that mates with said master plate, said secondary plate having a plurality of leaves, said plurality of teeth locks under said plurality of leaves to secure said master plate to said secondary plate.

2. The tool changer of claim 1 wherein said predetermined distance is approximately 30°.

3. The tool changer of claim 1 wherein said plurality of teeth have a slope on one side thereof.

4. The tool changer of claim 3 wherein said slope engages with said plurality of leaves and pulls up said secondary plate.

5. The tool changer of claim 1 wherein said master plate has a central pivot point.

6. The tool changer of claim 1 wherein said secondary plate has a locking pin.

7. The tool changer of claim 6 wherein said locking pin is a ball lock pin.

8. The tool changer of claim 6 wherein said locking pin limits said handle from rotating.

9. The tool changer of claim 1 wherein said master plate having an utility module connected thereto.

10. The tool changer of claim 9 wherein said utility module having electrical and air utilities.

11. A manual quick change tool changer for use in robotic based applications, said tool changer including:

a master plate, said master plate having a rotatable sprocket, said sprocket having a plurality of teeth;

a handle connected to said sprocket, said handle rotates a predetermined distance;

a secondary plate that mates with said master plate, said secondary plate having an orifice for said handle, said secondary plate having a plurality of leaves, said plurality of teeth overlap said plurality of leaves to secure said secondary plate to said master plate.

12. The manual quick change tool changer of claim 11 further including a thrust bearing engaging said sprocket.

13. The manual quick change tool changer of claim 11 wherein said master plate is partially inserted within said secondary plate to create a single unit.

14. The manual quick change tool changer of claim 11 wherein said predetermined distance is 30°.

15. The manual quick change tool changer of claim 11 wherein said plurality of teeth have a slope on one side thereof.

16. The manual quick change tool changer of claim 15 wherein said slope engages with said plurality of leaves and pulls up on said secondary plate.

17. The manual quick change tool changer of claim 11 wherein said master plate creates a central pivot point for said sprocket.

18. The manual quick change tool changer of claim 11 wherein said secondary plate having a locking pin.

19. The manual quick change tool changer of claim 18 wherein said locking pin is a ball lock pin.

20. The manual quick change tool changer of claim 11 further including an utility module connected to said master plate.

* * * * *